US005393231A

United States Patent [19]

Mak

[11] Patent Number: 5,393,231

[45] Date of Patent: Feb. 28, 1995

[54] CHILD'S MAGIC DRAWING BOARD

[75] Inventor: Kai-Shun Mak, Kwai Chung, Hong Kong

[73] Assignee: Hop Lee Cheong Industrial Co. Ltd., Hong Kong

[21] Appl. No.: 891,040

[22] Filed: Jun. 1, 1992

[51] Int. Cl.[6] ..... B43L 1/12

[52] U.S. Cl. ..... 434/410

[58] Field of Search ..... 434/410, 408, 413, 416

[56] References Cited

U.S. PATENT DOCUMENTS 4,763,929 8/1988 Weil ..... 434/410 X 5,083,925 1/1992 Maruyama ..... 434/410

*Primary Examiner*—Gene Mancene

*Assistant Examiner*—Jeffrey A. Smith

*Attorney, Agent, or Firm*—Burns, Doane, Swecker & Mathis

[57] ABSTRACT

A magic drawing board comprises a base, an opaque sheet mounted on the base, a flexible transparent sheet anchored along one edge thereof to the base, and a coupling mechanism comprising a coupling element on the base and a mating coupling element on the opposite edge of the transparent sheet for locating the transparent sheet in superposed position on the opaque sheet under uniform tension over the area of superposition, resulting in a higher quality image.

1 Claim, 1 Drawing Sheet

CHILD'S MAGIC DRAWING BOARD

FIELD OF THE INVENTION

The present invention relates to so called "magic" drawing boards for use by children, comprising a flexible sheet of resilient transparent material including a homogenous flourescent pigment and a sheet of opaque material, with the flexible sheet of resilient transparent material being moveable into and out of a position in which it is superposed on the sheet of opaque material. With the transparent sheet superposed on the opaque sheet, the child may "write" on the upper surface of the transparent sheet using a suitable "pen". By "write" in this context is meant that the child can produce a letter, numeral, graphic or any other image, and by "pen" is meant a suitable instrument which may be used to make an impression in the material of the resilient sheet. The writing is visible by virtue of the fact that external light shines through the impressed transparent sheet and is reflected back from the upper surface of the opaque sheet, and the light picks out the impressions in the transparent sheet as an area of shadow. When the flexible transparent sheet is moved out of superposition, the transparent sheet regains its original (non-impressed) flat shape, thereby obliterating the writing and leaving the drawing board clear for further use.

PRIOR ART

A traditional magic drawing board comprises a fixed rectangular body or "board" on which the opaque sheet is mounted and a corresponding rectangular frame on which the transparent sheet is mounted, the rectangular frame being pivotally moveable relative to the board so as to bring the transparent sheet into and out of superposition relative to the opaque sheet.

The traditional magic drawing board suffers from the disadvantage that the transparent sheet may not be brought into exact intimate superposition. Instead the flexible transparent sheet may contact the opaque sheet over only part of the area thereof and not over the remainder. The lack of intimate contact results in shadows in the reflected light which distort the image written by the child. One reason for the lack of exact superposition is that during manufacture the flexible transparent sheet may not be located in the rectangular frame in the exactly correct position and under uniform tension. Another reason for the lack of exact superposition is that there may be some tolerance or play in the pivot joint so that the rectangular frame does not exactly engage the board.

OBJECT AND SUMMARY OF THE INVENTION

An object of the present invention is to provide a magic drawing board in which the superposition of the flexible transparent sheet on the opaque sheet may be achieved on a consistent basis over the entire area of superposition.

The invention provides a magic drawing board comprising a base, an opaque sheet mounted on the base, a flexible transparent sheet anchored along one edge thereof to the base, and a coupling mechanism comprising a coupling element on the base and a mating coupling element on the opposite edge of the transparent sheet for locating the transparent sheet in superposed position on the opaque sheet under uniform tension over the area of superposition.

The magic drawing board according to the invention is prepared for use by moving the flexible transparent sheet generally into position superposed on the opaque sheet, and then coupling together the coupling elements on the transparent sheet and on the base so that the transparent sheet is tensioned with uniform tension over the area of superposition.

DETAILED DESCRIPTION OF THE PREFERRED EMBODIMENT

Figure 1:
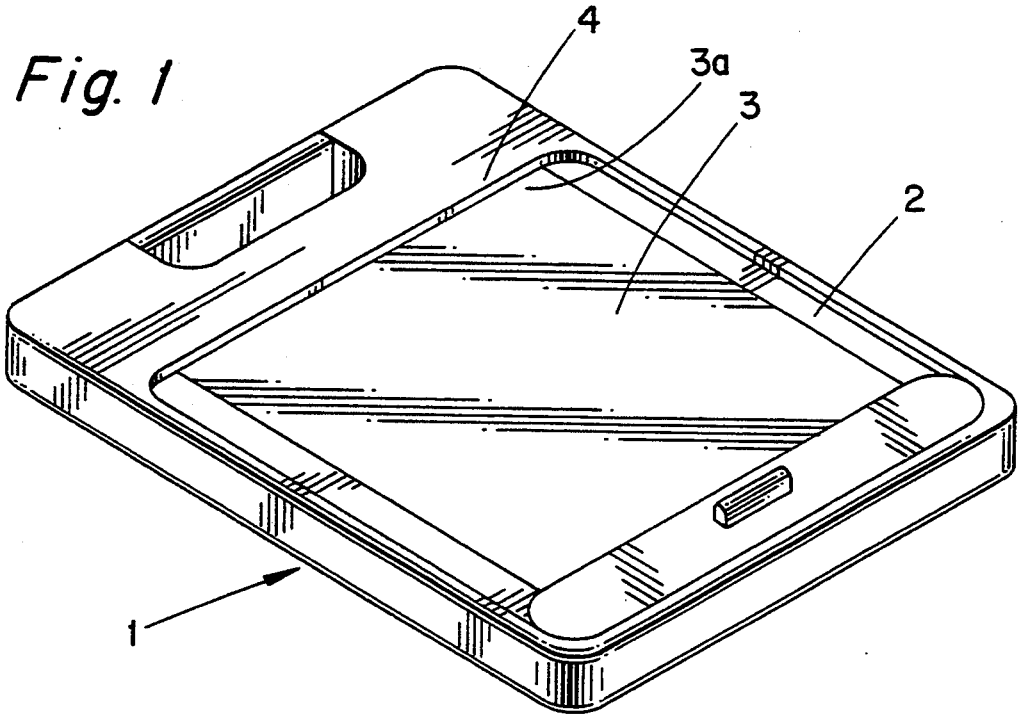
FIG. 1 is a perspective view of the magic drawing board with the transparent sheet in superposition.

Referring to the drawings, the magic drawing board consists of a base or board 1, an opaque sheet 2 permanently mounted to the base under uniform tension over the area thereof, a flexible transparent sheet 3 permanently mounted along one edge 3*a* thereof to the board by mounting means 4, a male coupling element 5 mounted to the opposite edge of the transparent sheet 3, and a female coupling element 6 in the form of a recess in the base 1.

Figure 2:
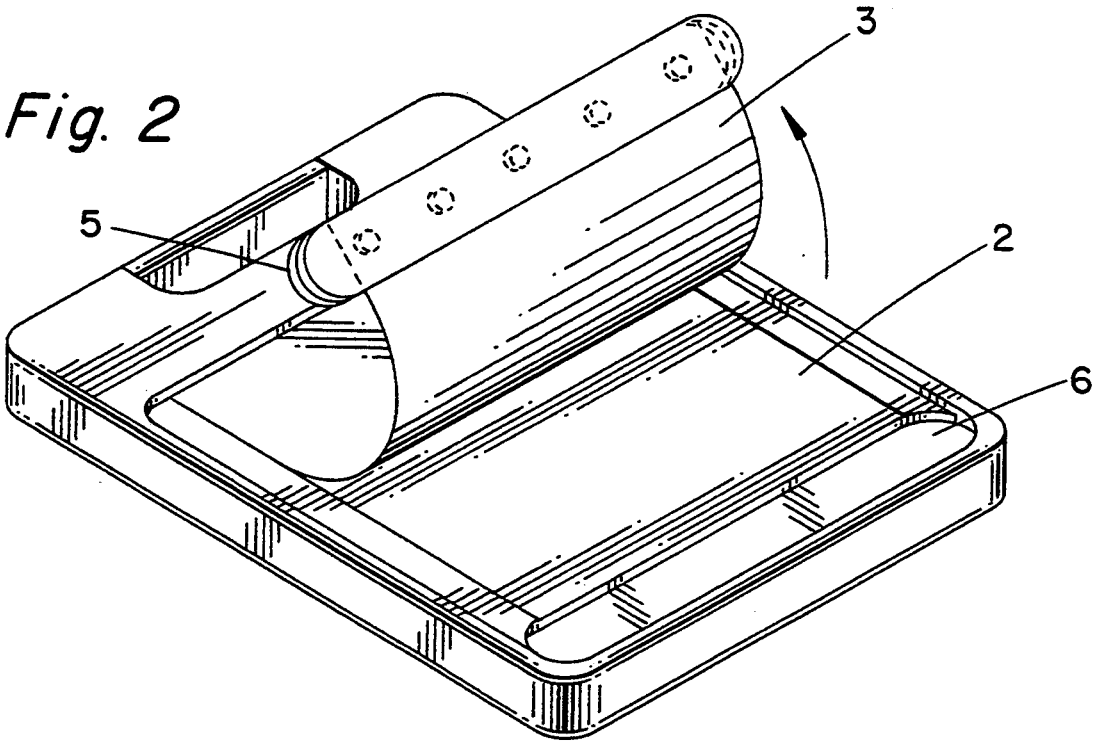
FIG. 2 is a similar view but with the transparent sheet rolled back.

To prepare the drawing board for use, the transparent sheet 3 is moved to the position shown in FIG. 2 in which the transparent sheet 3 and the opaque sheet 2 are completely out of contact with one another, thereby allowing the transparent sheet 3 to regain its non-impressed shape and thus obliterating any written matter so as to leave the drawing board clear for further use. The transparent sheet 3 is then moved to the generally superposed position and the coupling elements 5, 6 are then coupled together so that the transparent sheet 3 is tensioned uniformly in contact with the opaque sheet 2 as shown in FIG. 2.

In use of the magic drawing board, because the transparent sheet 3 and the opaque sheet 2 are each under uniform tension over the area thereof, they are in intimate contact with one another over the entire area, so that no shadows are present, and the writing by the child results in an image which accurately reproduces what the child has written.

I claim:

1. A magic drawing board comprising a base having an upper surface, an opaque sheet mounted on the upper surface of the base, a flexible transparent sheet having one edge thereof permanently anchored to the base, and a detachable coupling mechanism including a first coupling element comprising a recess in the upper surface of the base and a mating coupling element comprising an elongated plastic molding along an edge of the transparent sheet that is opposite said one edge, which mating element can be coupled to said first coupling element to locate the transparent sheet in superposed position on the opaque sheet and to provide uniform tension between said permanently anchored edge and said opposite edge over the area of superposition and decoupled from said first coupling element so that said transparent sheet is not under tension.

* * * * *